US005496238A

United States Patent [19]

Taylor

[11] Patent Number: 5,496,238

[45] Date of Patent: Mar. 5, 1996

[54] PHYSICAL CONDITIONING APPARATUS

[76] Inventor: Douglas B. Taylor, 5041 Clayton Rd., Concord, Calif. 94521

[21] Appl. No.: 109,975

[22] Filed: Aug. 19, 1993

Related U.S. Application Data

[63] Continuation-in-part of Ser. No. 979,640, Nov. 19, 1992, abandoned.

[51] Int. Cl.[6] ..... A63B 22/06

[52] U.S. Cl. ..... 482/63; 482/57; 482/97; 482/908

[58] Field of Search ..... 482/52, 56, 57, 482/58, 59, 60, 63, 64, 79, 93, 97, 908, 55, 65, 74, 80, 114, 115, 117, 112, 5; 601/33, 35, 36

[56] References Cited

U.S. PATENT DOCUMENTS

| | | | |
|---|---|---|---|
| 3,112,108 | 11/1963 | Hanke | 482/57 |
| 3,213,852 | 10/1965 | Zent | 482/63 |
| 3,572,699 | 3/1971 | Nies . | |
| 3,743,282 | 7/1973 | Zinkin . | |
| 3,759,511 | 9/1973 | Zinkin . | |
| 4,149,714 | 4/1979 | Lambert . | |
| 4,254,949 | 3/1981 | Brentham | 482/112 |
| 4,477,072 | 10/1984 | Decloux . | |
| 4,509,742 | 4/1985 | Cones | 482/58 |
| 4,519,603 | 5/1985 | Decloux . | |
| 4,548,406 | 10/1985 | Beistegui Chirapozu | 482/63 |
| 4,550,906 | 11/1985 | Im | 482/57 |
| 4,563,003 | 1/1986 | Bugallo . | |
| 4,606,241 | 8/1986 | Fredriksson | 482/57 |
| 4,673,178 | 6/1987 | Dwight | 482/57 |
| 4,712,791 | 12/1987 | Edwards | 482/112 |
| 4,753,435 | 6/1988 | Carnielli | 482/57 |
| 4,842,269 | 6/1989 | Huang . | |
| 4,854,577 | 8/1989 | Sims | 482/112 |
| 4,872,668 | 10/1989 | McGillis et al. | 482/5 |
| 4,878,663 | 11/1989 | Luquette . | |
| 4,955,599 | 9/1990 | Bersonnet . | |
| 4,982,955 | 1/1991 | Heasley . | |
| 5,016,871 | 5/1991 | Dalebout . | |
| 5,066,004 | 11/1991 | Jones | 601/35 |
| 5,102,121 | 4/1992 | Solow . | |
| 5,106,081 | 5/1992 | Webb . | |
| 5,114,389 | 5/1992 | Brentham | 482/113 |
| 5,139,255 | 8/1992 | Sollami . | |
| 5,190,511 | 3/1993 | Petree | 482/112 |
| 5,254,067 | 10/1993 | Habing et al. | 482/112 |
| 5,256,115 | 10/1993 | Scholder et al. | 482/63 |

FOREIGN PATENT DOCUMENTS

| | | | |
|---|---|---|---|
| 2301808 | 7/1974 | Germany | 482/63 |

*Primary Examiner*—Richard J. Apley
*Assistant Examiner*—Jeanne M. Clark

[57] ABSTRACT

Physical conditioning apparatus which includes a left foot pedal, a right foot pedal, a binder for binding the user's left foot onto the left foot pedal, a binder for binding the user's right foot onto the right foot pedal, support means for supporting the user, and resistance producing means for resisting upward movement of the foot pedals but producing little or no resistance to downward movement of the foot pedals.

4 Claims, 8 Drawing Sheets

PHYSICAL CONDITIONING APPARATUS

This is a continuation-in-part of application Ser. No. 07/979,640 filed on Nov. 19, 1992, abandoned.

BACKGROUND OF THE INVENTION

1. Field of the Invention

My present invention relates to physical conditioning apparatus, and more particularly to physical conditioning apparatus for improving the tonus of the rectus abdominis muscles and related muscular and neuronal structures of the human body.

2. Description of the Prior Art

Physical conditioning apparatus which may have some effect on the rectus abdominis muscles, etc., are well known in the prior art.

U.S. Pat. No. 5,139,255, issued on Aug. 8, 1992, to Phillip A. Sollami, discloses an exercise machine including a hydraulic torque resistance device having a rotor which is so connected to a pair of vertically movable pedals that simultaneously with the downward movement of one pedal the other pedal moves upward. More specifically, the force required to move the pedals up and down is constant throughout the entire range of pedal movement. The torque resistance device may be of any suitable construction wherein rotation of a shaft is resisted by a constant torque throughout its range of angular movement. An important feature of the exercise machine of Sollami is the fact that irrespective of the direction of movement of the pedals the force required to pivot the shaft 40 is constant throughout its entire stroke.

U.S. Pat. No. 5,106,081, issued to Gregory M. Webb on Apr. 21, 1992, discloses a leg exercise machine which includes a frame having a seat connected thereto for supporting a user in a seated position thereon. A single foot engaging member is adapted for engaging both feet of the user and receiving the sum of the forces applied by the user's legs. The single foot engaging member is movably mounted on the frame of the device by a four-bar linkage which includes first and second lever arms pivotably mounted on the frame. The second lever arm is operatively connected to a weight stack for transmitting the pivotal back-and-forth movement of the leg engaging member to movement of the weight stack to thereby exercise the legs of a user.

U.S. Pat. No. 4,477,072, issued to Richard J. DeCloux on Oct. 16, 1984, discloses a bimodal exercise device which simulates the exercise obtained in either of two modes of bicycling, e.g., sit-down, normal pedaling and stand-up hill climbing pedaling. Two different systems are disclosed, both yielding the desired bimodal choice of exercise. In both systems the "down" pedal is effectively braked or stopped to provide a step-up platform to provide for body listing in the "stand-up" mode.

U.S. Pat. No. 4,149,714, issued to Lloyd J. Lambert, Jr. on Apr. 17, 1979, discloses a seated weight-lifting leg press exercise machine comprising a seat which is adjustable on a trackway, a pair of foot platforms associated near the seat to allow one's feet to be placed thereon, a pivotal bar connecting these foot pedals so that horizontal displacement of one extremity of this pivot bar not only swings about an arc caused by the pivot, but is also connected at the extremity remote from the pivot with a linkage which indirectly lifts a pre-selected magnitude of weights. When the pedals are displaced in a horizontal sense, the linkage follows and retracts with this motion, and exercise work is done against the weights.

U.S. Pat. No. 3,759,511, issued to De Wayne Zinkin on Sep. 18, 1973, discloses a device for exercising the muscles of the legs, which simulates the striding movement which occurs during actual running. A body support frame is provided having a pair of foot-engaging pendulum arms mounted thereon for movement through predetermined arcuate paths of travel with an adjustable friction developing mechanism being operatively associated with an arcuate sector to offer resistance to movements of the arms. The device offers substantially a constant resisted force throughout the entire range of thrust movement during the extension of a user's leg and provides substantially unrestricted leg movement in the opposite direction during the retraction of a user's leg.

U.S. Pat. No. 3,743,282, issued to Harold Zinkin on Jul. 3, 1973, discloses an improved weight training device particularly adapted for exercise of the lower limbs, which device includes a weight stack, a seat facing away from the weight stack but adjacent thereto and a movable set of foot pedals disposed adjacent the seat on the side thereof opposite the weight stack. The pedals and weight stack are interconnected so that movement of the pedals away from the device raises the weight stack, i.e., the extension of the user's legs raises the weight stack against the resistance provided by the weight stack.

In using the device of Harold Zinkin the exerciser places his feet on the pedals and begins the exercise by pushing his feet away from him and against the force exerted by the pinned weights.

U.S. Pat. No. 3,112,108, issued to Clarence S. Hanke, on Nov. 26, 1963, discloses exercising apparatus with crankshaft-operable selectively by foot pedals or hand levers. The apparatus of Hanke includes a substantially rectangular open frame supported in an elevated position by a plurality of legs, the frame including a pair of side members and cross members. One cross member, disposed intermediate the ends of the frame, constitutes a seat for accommodating a user, the user being disposed in a reclining position with his back resting on a backrest. A crankshaft extends transversely of the frame in spaced relation to the seat and is rotatably journaled in suitable bushings or bearings provided in the side members and also in a central frame reenforcing member. The crankshaft has two throws spaced 180 degrees apart and having mounted thereon a pair of foot pedals. Each of these pedals includes a base or sole plate, a heel rest and an open toe cap. Each pedal is pivotably mounted on an associated throw of the crankshaft. Means are provided for introducing a variable resistance to rotation of the crankshaft so as to progressively train the patient in the strengthening of his muscles. These means comprise adjustable weights connected to cords or cables which pass over a pair of pulleys at the underside of a crossbar of a suitable supporting structure or framework, which crossbar may be either separate from the main frame or structurally joined to it. The cables are connected to eyes which are part of the foot pedals. Although the arrangement is such that during rotation of the crankshaft the cables cause one of the weights to rise while the other weight falls, the effective mass of the two weights may be individually varied so that either is heavier than the other, thus offering a greater resistance to rotation of the crank shaft by either foot.

It is believed that the documents listed immediately below contain information which is or might be considered to be material to the examination of this patent application.

| Patent No. | Inventor |
|---|---|
| 3,572,699 | H. Nies |
| 4,519,603 | R. DeCloux |
| 4,563,003 | F. Bugallo et al. |
| 4,842,269 | G. Huang |
| 4,878,663 | M. Luquette |
| 4,955,599 | G. Bersonnet et al. |
| 4,982,955 | R. Heasley |
| 5,016,871 | W. Dalebout et al. |
| 5,102,121 | H. Solow et al. |

Report of international patent database search for physical conditioning apparatus having pedals which are attached to the user's feet or shoes, and which resist the pedaling effort of the user only on the upward or contractile stroke (40 pages).

It is to be understood that the term "prior art" as used herein or in any statement made by or on behalf of applicant means only that any document or thing referred to as prior art bears, directly or inferentially, a date which is earlier than the effective filing date hereof.

No representation or admission is made that any of the above-listed documents is part of the prior art, or that no more pertinent information exists.

A copy of each of the documents referred to hereinabove is supplied to the Patent and Trademark Office herewith.

SUMMARY OF THE INVENTION

Accordingly, it is an object of my present invention to provide physical conditioning apparatus wherein the neuromuscular system of the user, and in particular the user's rectus abdominis muscles and their related neuronal connections, are efficiently conditioned, and the tonus of the same improved.

Another object of my present invention is to provide physical conditioning apparatus for improving the tonus of the user's rectus abdominis musculature and its neuronal connections whereby a contractile load or resistance can be applied to each of the user's legs independently, and which apparatus further comprises synchronism indicating means for indicating the instantaneous phase relationship between the movements of the user's legs.

Yet another object of my present invention is to provide physical conditioning apparatus for improving the tonus of the user's rectus abdominis musculature and the neuronal connections thereof, whereby contractile loads or resistances may be independently applied to each of the user's legs, or whereby the leg movement phase relationship of the application of such loads or resistances to the user's respective legs may be determined by the user.

A further object of my present invention is to provide physical conditioning apparatus whereby a contractile load or resistance can be applied to each of the user's legs independently and an extensional load or resistance of lesser magnitude can be applied to each of the user's legs independently.

Another object of my present invention is to provide physical conditioning apparatus whereby said contractile loads and said extensional loads can be varied independently.

A further object of my present invention is to provide physical conditioning apparatus as hereinabove described which is efficient, compact, and reasonable in cost.

Yet another object of my present invention is to provide physical conditioning apparatus as hereinabove described wherein the posture of the user may be a seated posture, a reclining posture, or a forward supine posture.

An additional object of my present invention is to provide physical conditioning apparatus as abovedescribed which may be implemented in fluidic, electrical, or completely mechanical embodiments, whereby varying attributes of such embodiments, such as cost, compactness, and convenience, may be optimized in variant embodiments thereof.

Other objects of my present invention will in part be obvious and will in part appear hereinafter.

My present invention, accordingly, comprises the several steps and the relation of one or more of such steps with respect to each of the others, and the apparatus embodying features of construction, combinations of elements, and arrangements of parts which are adapted to effect such steps, all as exemplified in the following disclosure, and the scope of my present invention will be indicated in the appended claims.

In accordance with a principal feature of my present invention physical conditioning apparatus is provided which comprises movable means, such as pedals, mounted on a frame for alternate upward and downward movement, attaching means for attaching the feet of a human user to said movable means, respectively, and resistance producing means for providing a predetermined amount of resistance to the upward movement of said moveable means, respective] y, and for applying substantially less or no resistance to the downward movement of said movable means, respectively.

In accordance with another principal feature of my present invention the amounts of resistance applied by said resistance producing means to the upward movement of said movable means are independently variable.

In accordance with a further principal feature of my present invention said resistance producing means also apply amounts of resistance to downward movement of said moveable means.

In accordance with another principal feature of my present invention said amounts of resistance applied to downward movement of said moveable means are independently variable.

In accordance with a yet further principal feature of my present invention said amounts of resistance to downward movement of said moveable means are less than said amounts of resistance to upward movement of said moveable means.

In accordance with yet another principal feature of my present invention said physical conditioning apparatus further comprises selective coupling means for selectively coupling said movable means together for joint movement or alternatively for uncoupling said movable means for independent movement.

In accordance with an additional principal feature of my present invention said selective coupling means are so constructed and arranged that said movable means can be coupled together in phase opposition, so that the first movable means moves downward when the second movable means moves upward and the first movable means upward when the second movable means moves downward.

In accordance with yet another principal feature of my present invention said selective coupling means are so constructed and arranged that said movable means can be coupled together in phase conjunction so that the first movable means and the second movable means move upwardly together and move downwardly together.

In accordance with another principal feature of my present invention said selective coupling means are so constructed and arranged that said movable means can be coupled together in any selected one at a time of a plurality of different phase relationships.

In accordance with yet another principal feature of my present invention, and particularly an embodiment thereof wherein said movable means are independently movable, said apparatus comprises indicator means for indicating the instantaneous phase relationship between the movement of the first movable means and the movement of the second movable means.

In accordance with a further principal feature of my present invention said physical conditioning apparatus may be provided in a totally mechanical form in which each of such resistance producing means includes weight means and coupling means for so coupling said movable means to said weight means that said weight means provide said predetermined amounts of resistance to upward movement of the respective movable means.

In accordance with another principal feature of my present invention physical conditioning apparatus thereof may be provided wherein the first and second resistance producing means are fluidic systems, whereby compact apparatus may be provided which has great flexibility of control.

In accordance with yet another principal feature of my present invention physical conditioning apparatus thereof may be provided in which said resistance producing means are electrical systems, which systems are characterized by compactness and flexibility of control.

In accordance with another principal feature of my present invention said weight means are variable over a wide range, such that the resistance applied to a leg of the user ranges from one-half pound or less to 20 pounds or more, so that the physical conditioning apparatus of my invention is not limited to use by robust, athletic individuals, but also may be used in providing physical conditioning for infirm aged persons, etc.

For a fuller understanding of the nature and objects of my present invention, reference should be had to the following detailed description, taken in connection with the accompanying drawings.

DESCRIPTION OF THE PREFERRED EMBODIMENTS

Figure 1:
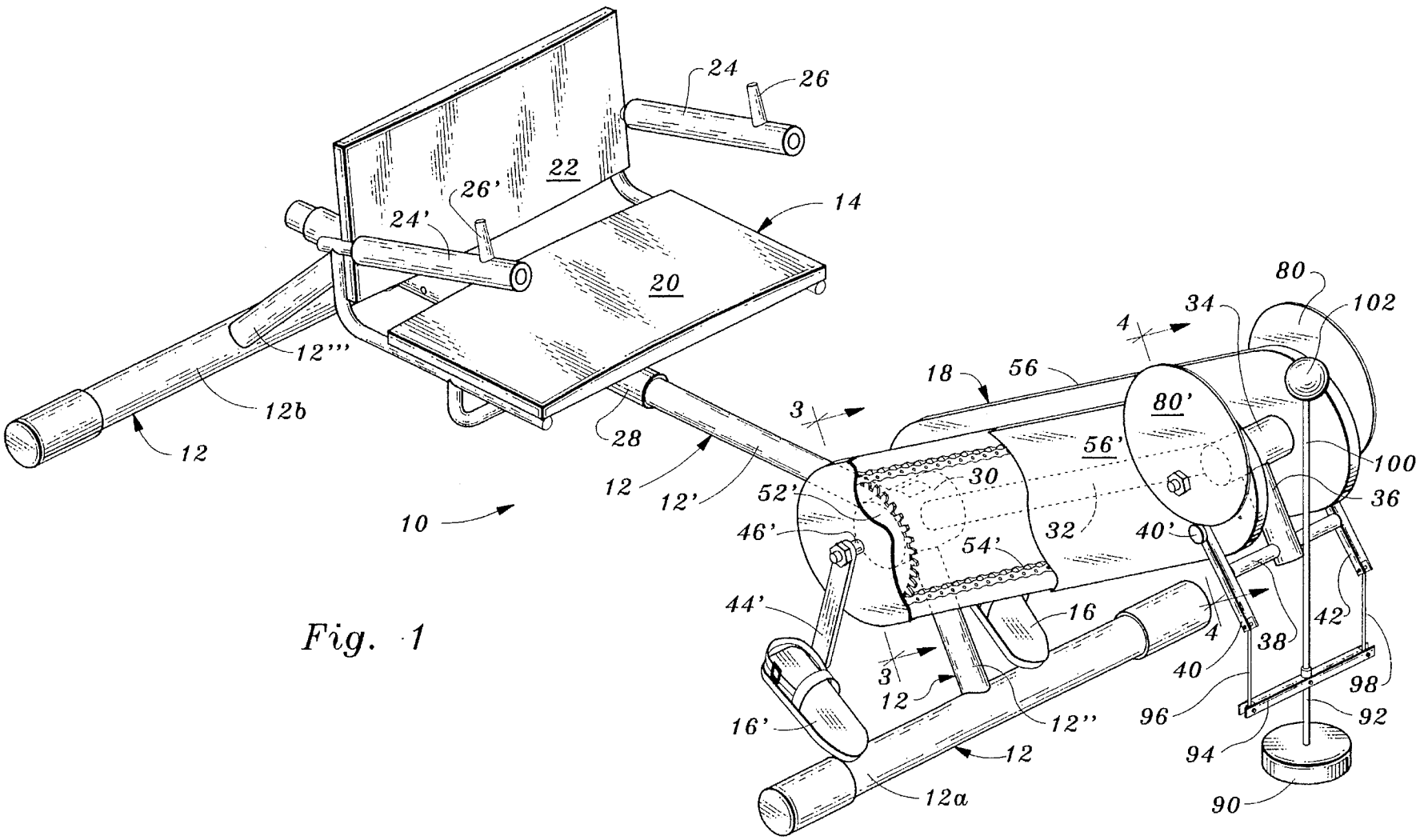
FIG. 1 is a perspective view of a first preferred embodiment of my invention.

Referring now to FIG. 1, there is shown a physical conditioning device 10 constructed in accordance with the first preferred embodiment of my invention.

As seen in FIG. 1, physical conditioning device 10 is generally comprised of a floor contacting frame 12 on which is mounted a seat 14, a pair of pedals 16, 16' and a resistance producing assembly 18.

Seat 14 is comprised of a seat 20, a seat back 22, and a pair of arms 24, 24'. Each arm 24, 24' is provided with a handle 26, 26'. Seat 20, seat back 22, arms 24, 24' and handles 26, 26' are preferably faced with resilient material for the comfort of the user.

Seat 14 is mounted upon a sliding sleeve 28 which is slidably mounted on the spine 12' of frame 12. Sleeve 28 is rotatable about the axis of spine 12', and is provided with locking means whereby it, and thus seat 14, can be locked to spine 12' at any one of a plurality of positions, at the election of the user.

The provision of additional adjustability features whereby seat 14 may be adjusted in height above spine 12', the angle of inclination of the backrest 22 may be adjusted, etc., will be provided by those having ordinary skill in the art without the exercise of invention.

Frame 12 is further comprised of two upwardly extending legs 12", 12'". Each leg 12", 12'" is affixed at its upper end to spine 12' at a predetermined angle.

The lower end of rear leg 12'" is affixed to a foot **12*b*; and the lower end of front leg 12" is affixed to a foot 12*a*. Thus, seat 14 is maintained in the fixed position parallel to the ground shown in FIG. 1 and is adjustable in position along spine 12'**.

Referring again to FIG. 1, it will be seen that spine 12' and front leg 12" are both rigidly affixed to a cylindrical bearing housing 30 (FIG. 3), and that a resistance producing assembly support arm 32 is also rigidly affixed to bearing housing 30.

As further seen in FIG. 1, a generally cylindrical bearing block 34 is rigidly affixed to the outer end of resistance producing assembly support arm 32. A cam follower support arm 36 is rigidly affixed to bearing block 34 and depends downwardly therefrom. A cam follower pivot shaft 38 is mounted in the outer end of cam follower support arm 36, and cam followers 40, 42 are respectively pivotably mounted on the outer ends of cam follower pivot shaft 38.

Figure 2:
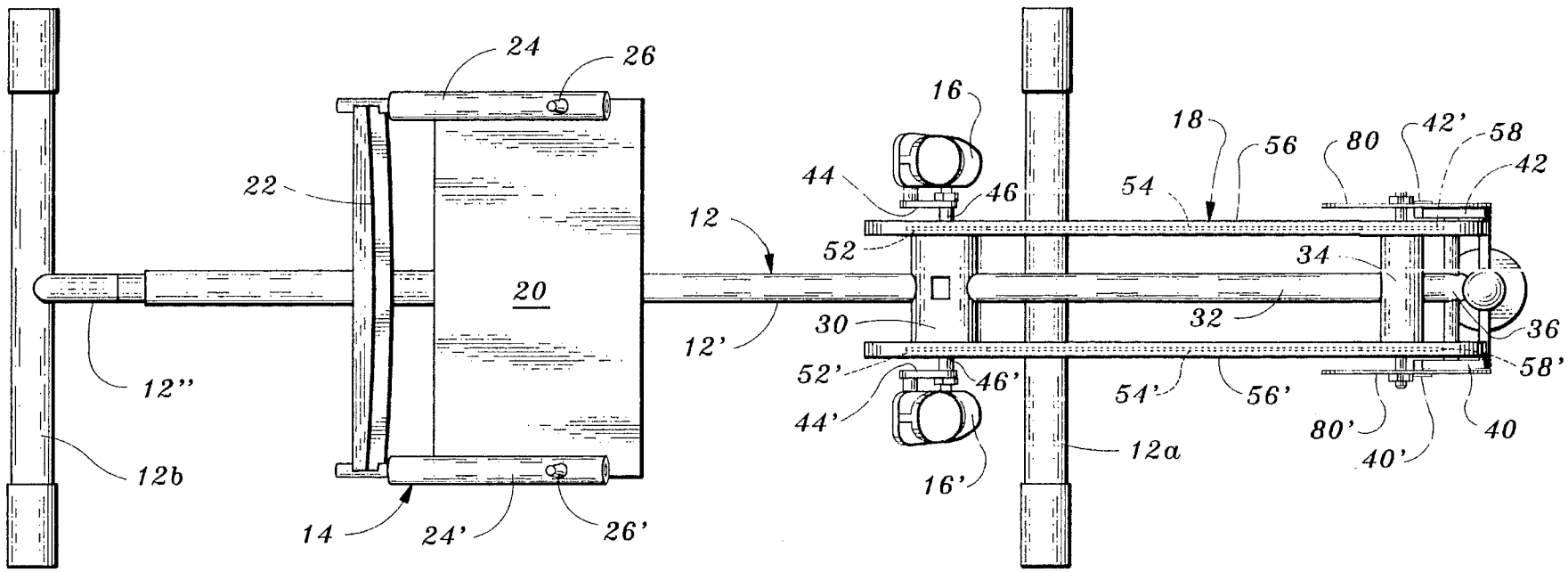
FIG. 2 is a plan view of the first preferred embodiment of my invention shown in FIG. 1.

Comparing FIGS. 1 and 2, it will be seen that pedals 16, 16' are respectively pivotably supported on the outer ends of crank arms or cranks 44, 44'.

Figure 3:
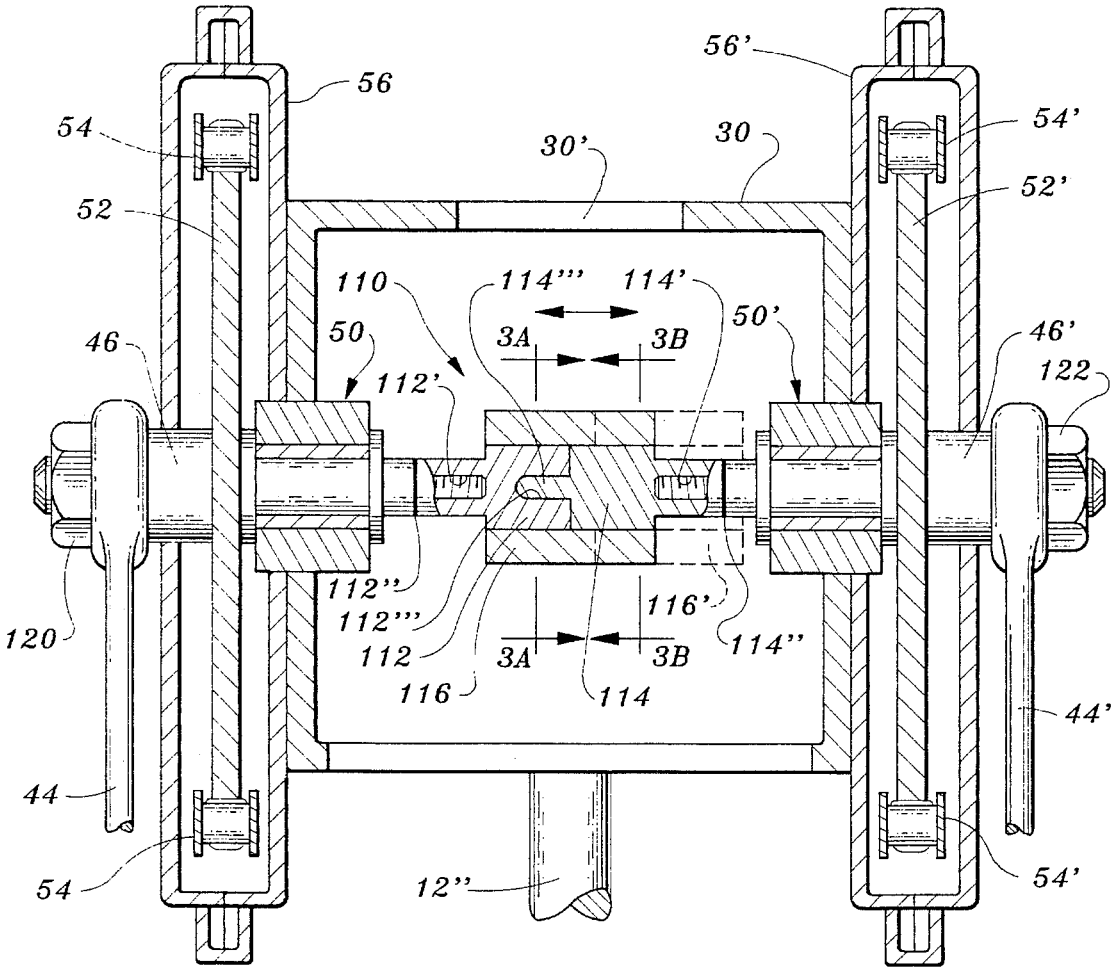
FIG. 3 is a partial sectional view of the first preferred embodiment of my invention shown in FIG. 1, taken on plane 3—3 of FIG. 1.

As best seen in FIG. 3, the inner ends of cranks 44, 44' are mounted, respectively, on crankshafts 46, 46', and crankshafts 46, 46' are respectively journaled in bearings 50, 50', which are themselves fixedly mounted in close-fitting openings in the opposite circular end walls of bearing housing 30.

As also best seen in FIG. 3, circular sprockets 52, 52' are respectively irrotatably mounted on crankshafts 46, 46' for joint rotation therewith.

Comparing FIGS. 1 and 3, it will be seen that a bicycle chain 54' is engaged with the teeth of sprocket 52', and that a corresponding bicycle chain 54 is engaged with the teeth of a sprocket 52.

Comparing FIGS. 1, 2 and 3, it will be seen that each bicycle chain 54, 54', and its associated circular sprockets, is contained within an associated chainguard, 56, 56', respectively.

As may be seen by comparison of FIGS. 1 and 3, chainguards 56, 56' are affixed to the opposite ends of bearing housing 30, and are also affixed to the outer ends of bearing block 34.

As best seen in FIG. 2, the outer ends of bicycle chain 54, 54' remote from inner sprockets 52, 52' are respectively engaged with outer sprockets 58, 58'.

Figure 4:
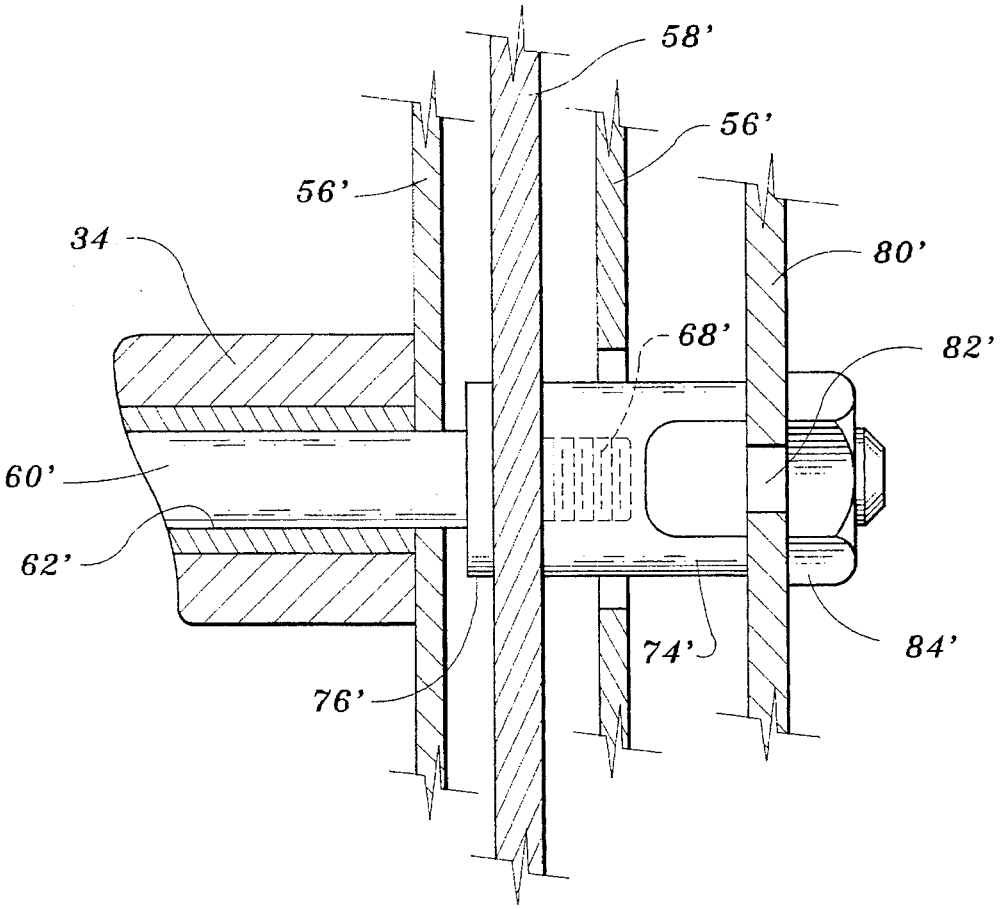
FIG. 4 is a partial sectional view of the first preferred embodiment of my invention shown in FIG. 1, taken on plane 4—4 of FIG. 1.

As best seen in FIG. 4, outer sprocket 58' is mounted on a shaft 60'. Shaft 60' is journaled in a bearing 62' which is itself fixedly mounted in bearing block 34. Similarly, left hand outer sprocket 58 is mounted on left sprocket shaft 60, and left sprocket shaft 60 is journaled in a bearing 62, which is fixedly mounted in the opposite end of bearing block 34 from bearing 62', and is coaxial with bearing 62'.

As further seen in FIG. 4, the outer end of shaft 60' is a reduced, threaded portion 68' thereof. A sprocket nut 74' is engaged with the threads 68' of sprocket shaft 60', and holds sprocket 58' captive between itself and a shoulder 76' of sprocket shaft 60', thereby maintaining the plane of symmetry of sprocket 58' perpendicular to the axis of sprocket shaft 60'.

As will be understood by those having ordinary skill in the art, informed by the present disclosure, sprocket 58 is mounted i upon a sprocket shaft 60 by means of a sprocket nut 74, which is substantially identical to sprocket retaining nut 74', sprocket shaft 60 being rotatably mounted in the opposite (left) end of bearing block 34.

Referring again to FIGS. 1 and 2, it will be seen that a pair of eccentric cams 80, 80' are respectively mounted outside the outer ends of chainguards 56, 56'.

Referring again to FIG. 4, it will be seen that eccentric cam 80' is mounted on a stub shaft 82' which projects from the outer face of sprocket nut 74' and is coaxial therewith.

As also seen in FIG. 4, cam 80' is captive between sprocket nut 74' and a cam nut 84' which is threadedly engaged with suitable threads provided on the outer end of stub shaft 82'.

It is to be understood that while cam 80', in many embodiments of my invention, is frictionally engaged with the outer face of sprocket nut 74' for joint rotation therewith, there may be other embodiments of my invention in which suitable locking means, such as pins and associated bores, are provided to positively lock cam 80' to sprocket nut 74'. In either event, it is to be understood that cam 80' in many embodiments of my invention, is made to be angularly adjustable about the axis of sprocket retaining nut 74', so as to be able to assume a number of different angular rotations thereabout, or to assume an infinite number of desired angular positions thereabout when sprocket 80' is only frictionally engaged with sprocket nut 74'.

Summarizing the above, it will be understood by those having ordinary skill in the art, informed by the present disclosure, that sprocket 58' and cam 80' are jointly mounted on sprocket shaft 60' for joint rotation in bearing 62', and that after the adjustment of the angular position of cam 80' as hereinabove described sprocket 58' and cam 80' are irrotatable with respect to each other, i.e., are both attached to sprocket shaft 60' for joint rotation therewith.

As will now be evident to those having ordinary skill in the art, informed by the present disclosure, the corresponding left hand members 58, 80, 60, 62, 74, etc., are constructed and arranged in the same manner, so that sprocket 58 and cam 80 are jointly rotatable with sprocket shaft 60, which is itself rotatably mounted in the left hand end of bearing block 34.

Thus, it will be evident to those having ordinary skill in the art, informed by the present disclosure, that the rotation of crank 44' about its axis, i.e., the axis of crankshaft 46' (FIG. 3), results in a corresponding angular rotation of cam 80' about the axis of sprocket shaft 60'. Similarly, angular rotation of crank 44 about its axis results in corresponding angular rotation of cam 80 about its axis of rotation, i.e., the axis of sprocket shaft 60.

Referring again to FIG. 1, there is shown a weight 90 having a stem 92.

It is to be understood that while a single weight 90 is employed in the first preferred embodiment of my invention, and is thus shown in FIG. 1, other embodiments of my invention may employ instead a plurality of discoid weights adapted to be carried by a platform affixed to the lower end of stem 92, whereby the numerical value of weight 90 may be varied in accordance with the desires of the user or the particular application of the device of my invention.

As further seen in FIG. 1, the upper end of stem 92 is pivotably affixed to a crosslink 94.

The opposite ends of crosslink 94 are attached, respectively, to the outer ends of the arms of cam followers 40, 42 by short cable segments 96, 98. Short cable segments 96, 98 may be replaced by other expedients of the type well known to those having ordinary skill in the art, such as links having universal joints at their top and bottom ends.

A rigid staff 100 is rigidly affixed to crosslink 94 so that it remains at all times perpendicular to crosslink 94.

A ball or sphere 102 is affixed to the upper end of staff 100, staff 100 being of such length that indicator ball 102 is visible to the user of apparatus 10 when seated in seat 14.

As will be evident to those having ordinary skill in the art, informed by the present disclosure, the angular position of crosslink 94 with respect to the horizontal is indicated to said user seated in seat 14 by the position and motion of indicator ball 102.

Thus, when pedals 16, 16' operate independently as explained hereinbelow in connection with FIG. 3, the instantaneous phase relationship between pedals 16, 16' is indicated to the user by the horizontal position and motion of indicator ball 102.

Further, as will also be evident to those having ordinary skill in the art, informed by the present disclosure, weight 90 (via cam followers 40, 42, crosslink 94, etc., and via bicycle chains 54, 54') applies countertorque to the rotation, respectively, of the pedals 16, 16' whenever the rotation of a cam 80, 80' is such as to drive its associated follower wheel 40', 42' downward.

Thus, for example, the phase relationship between crank 44' and cam 80' is so set that the effect of weight 90 is to apply countertorque to the rotation of crank 44 when pedal 16' is moving upwardly but to oppose little or no countertorque to the rotation of crank 44' when pedal 16' is moving downwardly.

As will be evident to those having ordinary skill in the art informed by the present disclosure this state of phase relationship between crank 44' and cam 80' is achieved when follower wheel 40' passes closest to the axis of rotation of cam 80' and at the same time crank 44' is directed vertically downwardly from its axis.

For the purposes of this disclosure it is arbitrarily assumed that crank 44' and cam 80' are "in phase" when follower wheel 40' is closest to the axis of rotation of cam 80' and crank 44' is directed vertically downward. Thus, these two machine elements are said to be "in phase opposition" when, for example, follower wheel 40' is at its nearest point to the axis of rotation of cam 80' and crank 44' is directed vertically upward.

As will be evident to those having ordinary skill in the art, informed by the present disclosure, the immediately preceding discussion relating to the phase interrelationship between crank 44' and cam 80' applies as well to crank 44 and cam 80, allowing for the fact that these crank-cam pairs are viewed from opposite sides of apparatus 10.

Referring now to FIG. 3, there is shown crank coupler 110, which is contained within bearing housing 30.

Crank coupling 110 is comprised of a left crankshaft extension 112, a right crankshaft extension 114, and a slidable collar 116 embracing both crankshaft extensions.

Left crankshaft extension 112 is provided with a threaded bore 112' which is threadedly engaged with a threaded projection of crankshaft 46. A lockwasher 112" or the like locks left crankshaft extension 112 against rotation with respect to crankshaft 46.

Similarly, right crankshaft extension 114 is provided with a threaded bore 114' which is threadedly engaged with an externally threaded projection of right crankshaft 46', and a lockwasher 114" or the like is provided to prevent relative rotation between right crankshaft extension 114 and right crankshaft 46'.

As also seen in FIG. 3, right crankshaft extension 114 is provided with a cylindrical finger 114'" which is close-fittingly received in a corresponding bore 112'" in left crankshaft extension 112, whereby to prevent whipping and maintain coaxial alignment between left crankshaft extension 112 and right crankshaft extension 114.

Figure 3A:
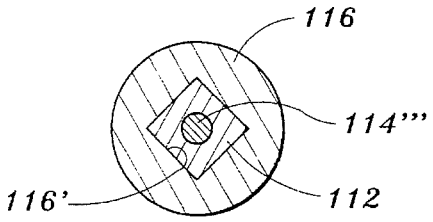
FIG. 3A is a sectional view taken on plane 3A—3A of FIG. 3.
Figure 3B:
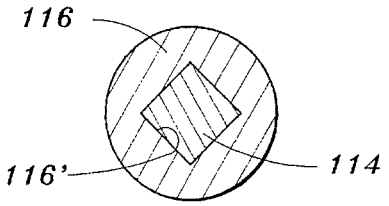
FIG. 3B is a sectional view taken on plane 3B—3B of FIG. 3.

Referring now to FIGS. 3A and 3B, and comparing the same with FIG. 3, it will be seen that the outer surface of collar 116 is generally cylindrical in form, and that the passage 116' extending axially through collar 116 is of square cross-section.

As seen in FIG. 3A, the enlarged portion of left crankshaft extension 112 which is disposed within collar 116 is of square cross-section, and is close-fittingly received within internal passage 116' of collar 116.

Referring to FIG. 3B, it will be seen that the enlarged portion of right crankshaft extension 114 which is received within collar 116 is square in cross-section, and is close-fittingly received within internal passage 116' of collar 116.

Referring again to FIG. 3 it will be seen that collar 116 is axially slidable on the enlarged portions of left crankshaft extension 112 and right crankshaft extension 114, and that thus collar 116 can be slidably displaced to its position indicated in dashed lines, wherein it surrounds right crankshaft extension 114 but does not surround left crankshaft extension 112.

Thus, as will be evident to those having ordinary skill in the art, informed by the present disclosure, collar 116 can be displaced from a position (solid lines) in which it closely embraces the enlarged portions of both crankshaft extensions 112, 114, and thus locks crankshaft extensions 112, 114 together for joint rotation, to a displaced position (dashed lines), in which crankshaft extensions 112, 114 are not locked together for joint rotation, but rather are freely rotatable with respect to each other.

Collar 116 can be shifted from its locking position (solid lines) to its non-locking position (dashed lines) by a suitable screwdriver or other instrument inserted through opening 30' in the top of bearing housing 30.

If necessary, suitable detenting means of well known type can be provided for maintaining collar 116 in either its locking position or its non-locking position.

Since, as explained hereinabove, crankshafts 46, 46' are irrotatably affixed to their corresponding crankshaft extensions 112, 114, it will be seen by those having ordinary skill in the art that by suitable positioning of collar 116 cranks 44, 44' can be selectively (a) disengaged from each other for independent rotation, (b) coupled together in phase opposition for joint rotation, (c) coupled together in phase conjunction (FIG. 1) for joint rotation, (d) coupled together in left leading quadrature, i.e., with left crank 44 ninety degrees of rotation ahead of right crank 44', or (e) coupled together in right leading quadrature, i.e., with right crank 44' advanced ninety degrees in rotation from left crank 44.

If it is desired to provide more positively locked relative orientations of cranks 44 and 44', internal passage 116' and the adjacent ends of left crankshaft extension 112 and right crankshaft extension 114 may all be of n-polygonal cross-section, where n is greater than four.

Further, the angular position of cranks 44, 44' with respect to each other may alternatively be adjusted by loosening one of the nuts 120, 122 to such an extent as to permit the inner splines of, e.g., crank 44 to be axially moved clear of the external splines of crankshaft 46, whereupon crank 44 can be rotated to a different spline-aligned position, the splines reengaged, and nut 120 tightened.

Figure 5:
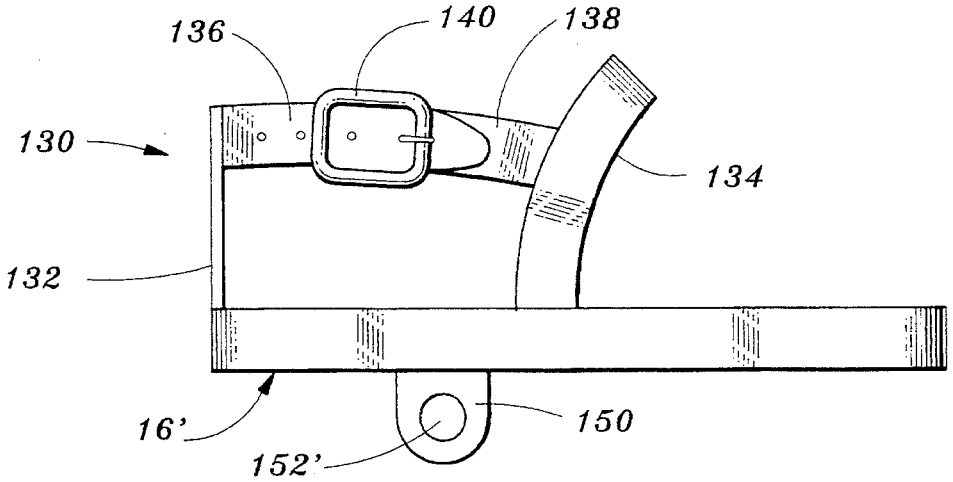
FIG. 5 is an elevational view of the foot pedal and foot binding apparatus of the first preferred embodiment of my invention shown in FIG. 1.
Figure 5A:
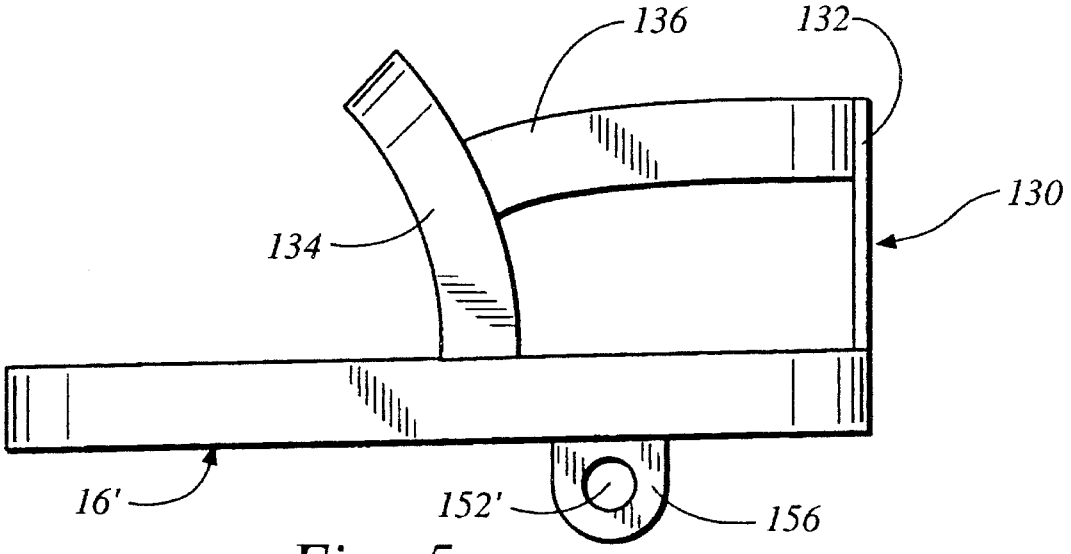
Figure 5B:
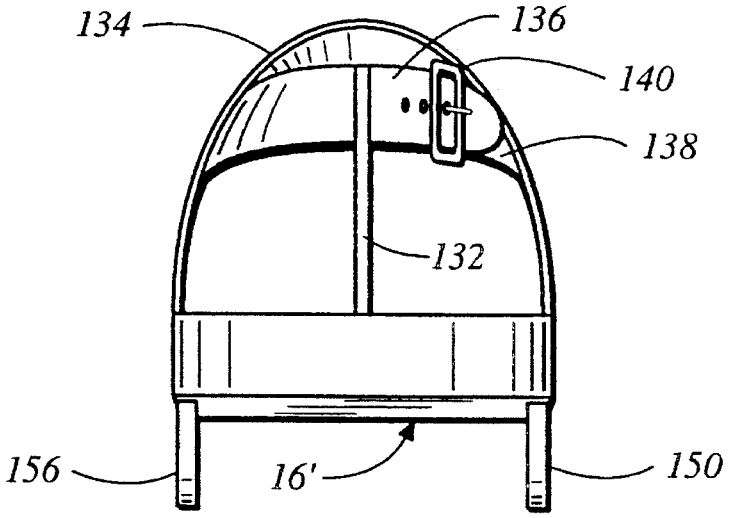

Referring now to FIG. 5, there is shown in detail pedal 16' (FIG. 1) and the system 130 of straps mounted thereupon for the purpose of attaching the user's right foot to pedal 16'.

It is to be understood that a similar strap system 130 is affixed to left pedal 16.

As seen in FIG. 5, strap system 130 comprises an upstanding heel strap 132, an instep strap 134, a tongue strap 138 which is affixed to instep strap 134, an ankle strap 136 which is affixed to instep strap 134 and heel strap 132 and extends beyond heel strap 132 in the form of a tongue which engages with buckle 140, which is itself affixed to strap 138 in the well known manner. Strap 138 is attached to instep strap 134.

Pedal 16 is provided with a similar strap arrangement which, however, is of mirror image configuration with respect to strap arrangement 130, so that the corresponding buckle is located on the outside of the user's left foot, just as the buckle 140 of strap arrangement 130 is mounted on the outside of the user's right foot, as seen in FIG. 5.

As further seen in FIG. 5, a bearing block 150 is affixed to the bottom of pedal 16' with its axis perpendicular to the major axis of pedal 16'.

Bearing block 150 is constructed and arranged to rotatably receive a pedal shaft 152'. Pedal shaft 152' is rigidly perpendicularly mounted on the outer end of crank 44'. Crank 44 is similarly provided with an outwardly projecting crankshaft 152 (not shown) which is rotatably received in a bearing block 156 (not shown) affixed to the bottom of pedal 16.

Thus, it will be seen by those having ordinary skill in the art, informed by the present disclosure, that each of the pedals 16, 16' is provided with strap means whereby the corresponding foot of the user, shod or unshod, can be attached thereto, and that each pedal 16, 16' is provided with a bearing block and bearing whereby it is rotatably affixed, in the perpendicular sense, to the outer end of its corresponding crank 44, 44'.

Figure 6:
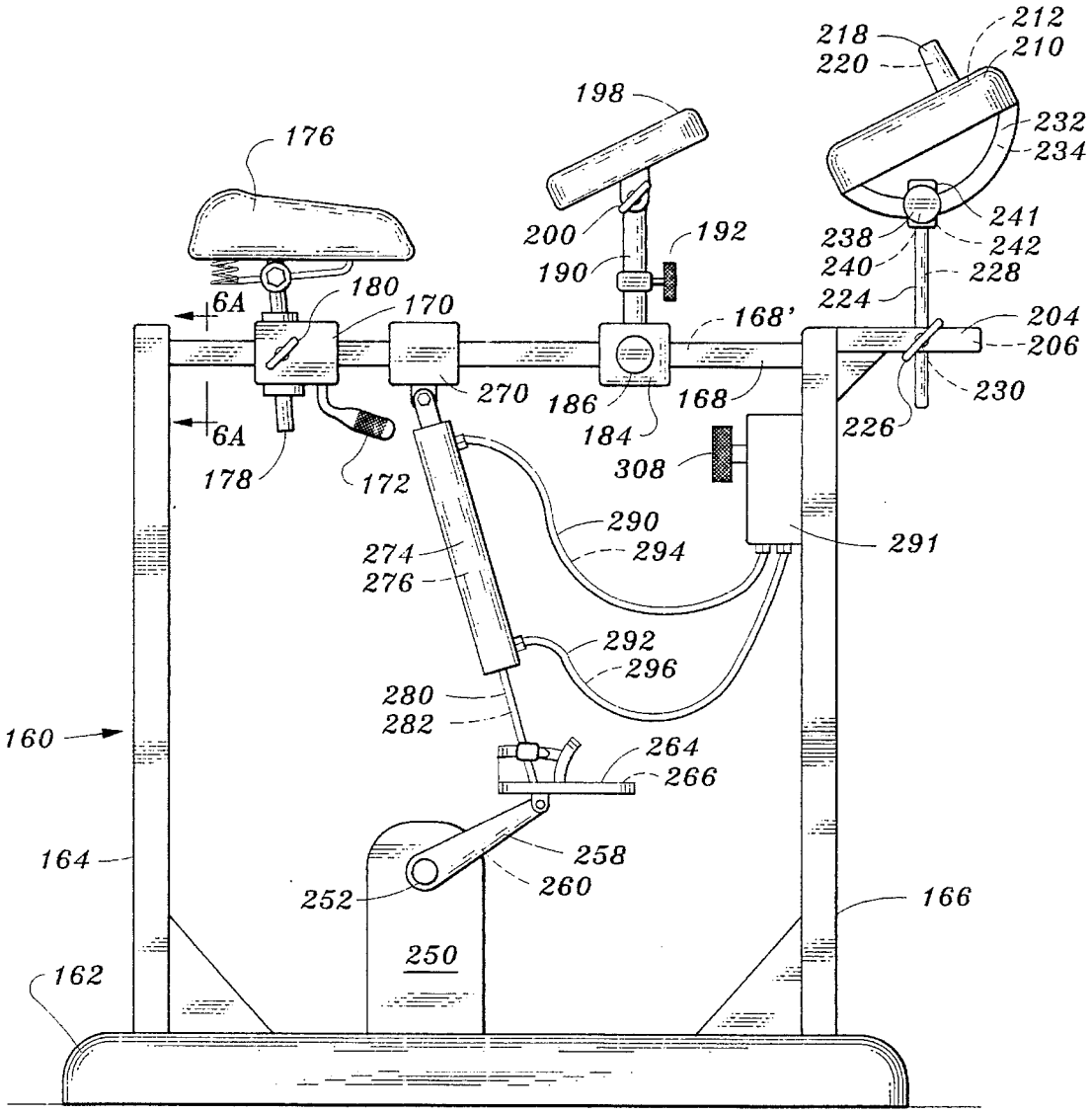
FIG. 6 is an elevational view of the second preferred embodiment of my invention.

Referring now to FIG. 6, there is shown a physical conditioning device 160 of the second preferred embodiment of my present invention.

Figure 6A:
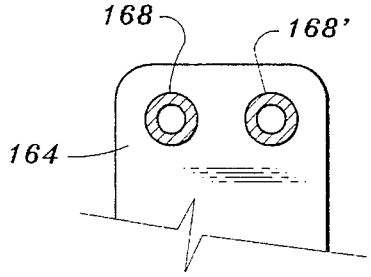
FIG. 6A is a partial sectional view of the second preferred embodiment of my invention shown in FIG. 6, taken on plane 6A—6A of FIG. 6.

Physical conditioning device 160 is comprised of a floor received platform or base 162, a rear upright 164 which is rigidly vertically mounted on base 162, a forward upright 166, which is rigidly vertically mounted on base 162, and a pair of rails 168, 168' which extend between and are respectively affixed to uprights 164, 166, as shown in FIG. 6A.

A saddle mounting block 170 is slidably mounted on rails 168, 168', and a friction lock 172 is provided for the purpose of locking saddle mounting block 170 to rail 168 at any desired position over the range of motion of saddle mounting block 170 on rails 168, 168'.

A saddle 176, similar to a bicycle saddle and having a stem 178, is mounted on saddle mounting block 170. More particularly, stem 178 passes through a vertical bore in saddle mounting block 170 and is lockable in saddle mounting block 170 at different elevational positions of saddle 176 by means of a screw the inner end of which frictionally engages stem 178 to lock it in its associated bore in saddle mounting block 170.

A chest receiver mounting block 184 is also slidably mounted on rails 168, 168', and is frictionally lockable to rail 168 by a screw having an outer knurled knob 186.

A selectively elongatable post 190 is rigidly perpendicularly affixed to chest receiver mounting block 184, and is frictionally lockable in various lengths by means of a screw 192 having an outer knurled knob.

A padded chest support plate 198 is pivotably mounted on the upper end of post 190, and its angle of inclination with respect to the axis of post 190 is frictionally fixable by means of a screw 200.

A pair of brackets 204, 206 are affixed to the upper end of upright 166, and extend outwardly therefrom as shown in FIG. 6.

A pair of armrests 210, 212 are mounted respectively on brackets 204, 206.

Armrest 210 is comprised of a rigid plate having a padded upper face and padded handles 218, 220 similar to handle 26 of FIG. 1, projecting upwardly therefrom.

A post 224 passing through a vertical bore in bracket 204 is frictionally lockable in that bore by means of a key-headed screw 226, and a post 228 passes through a vertical bore in bracket 206 and is frictionally lockable in that bore by means of a key-headed screw 230.

Thus, by means of key-headed screws 226, 230 the height of each armrest 210, 212 above rails 168, 168' may be selectively determined and fixed.

As also seen in FIG. 6, armrest 210 is provided with an arcuate yoke 232 and armrest 212 is provided with an arcuate yoke 234.

Yoke 232 passes through a passage in a receiving block 238 which is affixed to the top of post 224, and yoke 234 passes through a passage in a receiving block 240, which is affixed to the upper end of post 228.

A clamping screw 241 is provided to clamp yoke 232 in its associated passage in block 238 in any desired position, and a clamping screw 242 is provided to clamp yoke 234 in its associated passage in block 240 in any desired position.

Thus, it will be seen that saddle 176, chest receiver 198 and armrests 210,212 can be so adjusted with respect to rails 168, 168' as to comfortably accommodate a human user.

Referring again to FIG. 6, it will be seen that a mounting block 250 is affixed to base 162.

A shaft 252 is rotatably mounted in a bore extending through mounting block 250 and extends outwardly from both major faces of mounting block 250.

A right pedal crank 258 is rotatably mounted on the portion of shaft 252 which extends toward the viewer in FIG. 6.

Similarly, a left pedal crank 260 is pivotably mounted on the end of shaft 252 which projects from the opposite face of mounting block 250.

A pedal 264, similar to pedal 16' shown in FIGS. 1 and 5, is pivotably mounted on the outer end of pedal crank 258, and a pedal 266 similar to pedal 16 of the first preferred embodiment is pivotably mounted on the outer end of pedal crank 260.

It is to be understood that while pedal crank 260 is concealed behind pedal crank 258 and pedal 266 is concealed behind pedal 264 in FIG. 6, i.e., pedals 264 and 266 are in phase conjunction, physical conditioning device 160 can be adjusted so that pedals 264, 266 are locked together in phase opposition or in any other desired relative rotational relationship, or are independently rotatable. The provision of such pedal crank interconnecting means, e.g., clamping means for selectively clamping both pedals 264, 266 to shaft 252 or allowing free rotation of both pedals 264, 266 on shaft 252, is within the scope of one having ordinary skill in the art, and thus such means is not disclosed herein.

Referring again to FIG.6, it will be seen that a pivot block 270 is affixed to rails 168, 168' at a position directly above mounting block 250. M! A pair of hydraulic cylinders 274, 276 are pivotably affixed to pivot block 270, one above pedal crank 258 and one above pedal crank 260.

The outer end of the piston rod 280 of hydraulic cylinder 274 is pivotably affixed to the outer end of left pedal crank 258, and the outer end of the piston rod 282 of hydraulic cylinder 276 is pivotably affixed to the outer end of left pedal crank 260.

As also seen in FIG. 6, the inner end of hydraulic cylinder 274 is coupled by means of a suitable hydraulic hose 290 to a control box 291 which is affixed to the upper end of the inner face of upright 166.

Similarly, the outer end of hydraulic cylinder 274 is coupled to control box 291 by means of a suitable hydraulic hose 292.

Similarly, hydraulic cylinder 276 is coupled to control box 291 by means of hydraulic hoses 294, 296.

Figure 7:
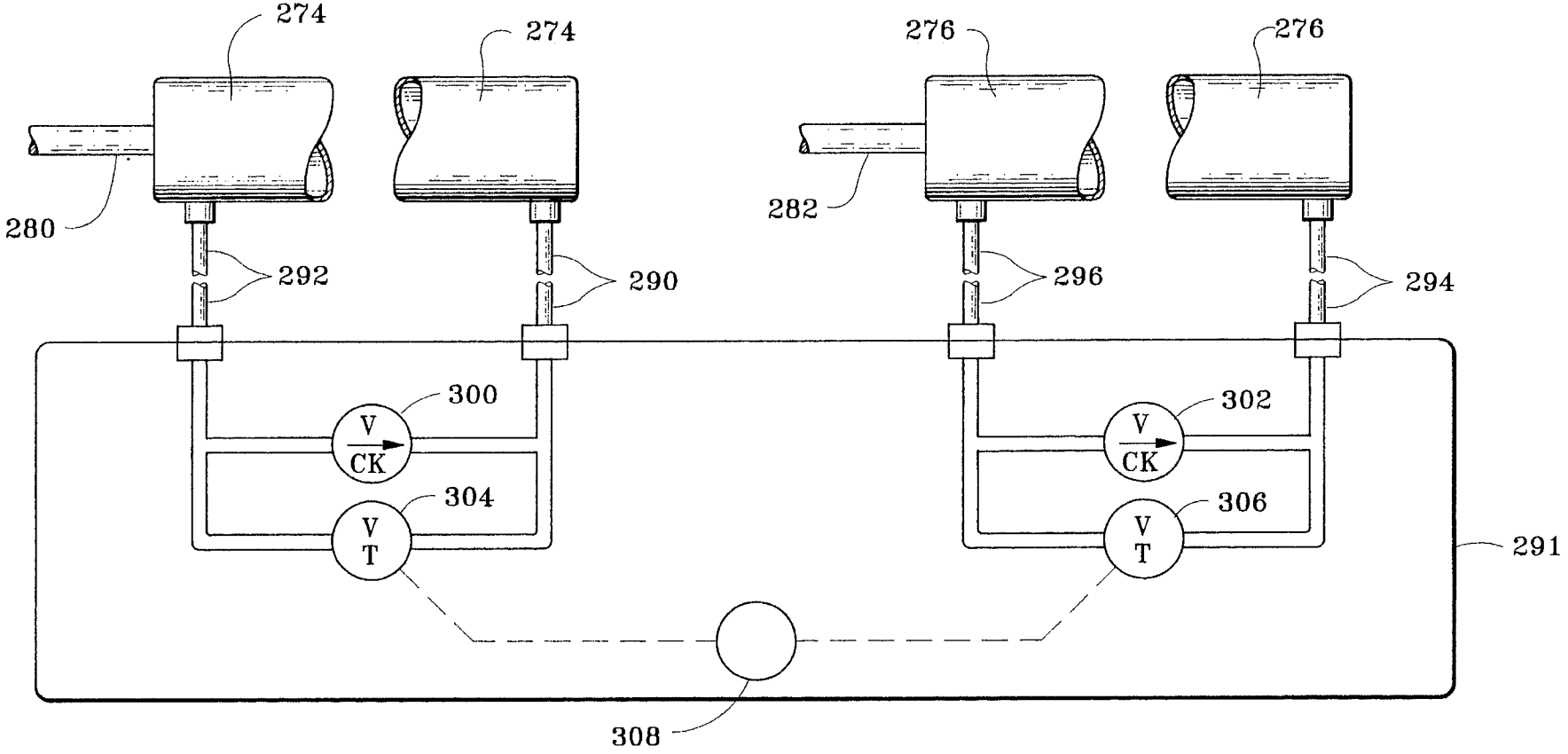
FIG. 7 is a schematic diagram of the hydraulic system of the second preferred embodiment of my invention shown in FIG. 6.

Referring now to FIG. 7, there is shown a schematic diagram of the hydraulic system of the second preferred embodiment of my invention.

As shown in FIG. 7, control box 291 contains two check valves 300, 302, and two throttle valves 304, 306.

As schematically represented in FIG. 7, throttle valve 304, 306 are mechanically coupled to a single control knob 308 whereby throttle valves 304 and 306 can simultaneously be manipulated between their fully open and fully closed positions, so that when manual control knob 308 is in one extreme position both throttle valves 304, 306 are closed, when manual control knob 308 is in its other extreme position both throttle valves 304, 306 are fully open, and at any intermediate position of control knob 308 throttle valves 304, 306 are opened to the same degree.

As also shown in FIG. 7, both check valve 300 and throttle valve 304 are connected in fluid circuit between hoses 290 and 292, and check valve 302 and throttle valve 306 are connected in fluid circuit between hoses 294 and 296.

It is also to be noted that check valve 300 blocks fluid flow from hose 290 to hose 292, and that check valve 302 blocks fluid flow from hose 294 to hose 296.

As will be evident to those having ordinary skill in the art, informed by the present disclosure, the hydraulic system of FIG.7 is so arranged that whenever either pedal 264, 266 is moved downwardly, the fluid flow in the corresponding part of the hydraulic system is in the non-blocking direction of the associated check valve, whereby little or no counterforce is opposed to the downward motion of either pedal 264, 266, but when either pedal 264, 266 is moving upwardly the fluid flow in the corresponding part of the hydraulic system shown in FIG. 7 is in the blocking direction of the associated check valve, and thus counterforce is opposed to the upward emotion of that pedal and the magnitude of that counterforce is controlled by the extent of opening of the corresponding throttle valve, both throttle valves being simultaneously controlled by manual control knob 308.

It will also be evident that if it is desired to reposition either pedal 264, 266 with respect to the other it is necessary only to fully open throttle valves 304, 306 by manipulating manual control knob 308 and to unclamp cranks 258 and 260 from shaft 252 as abovedescribed.

Figure 8:
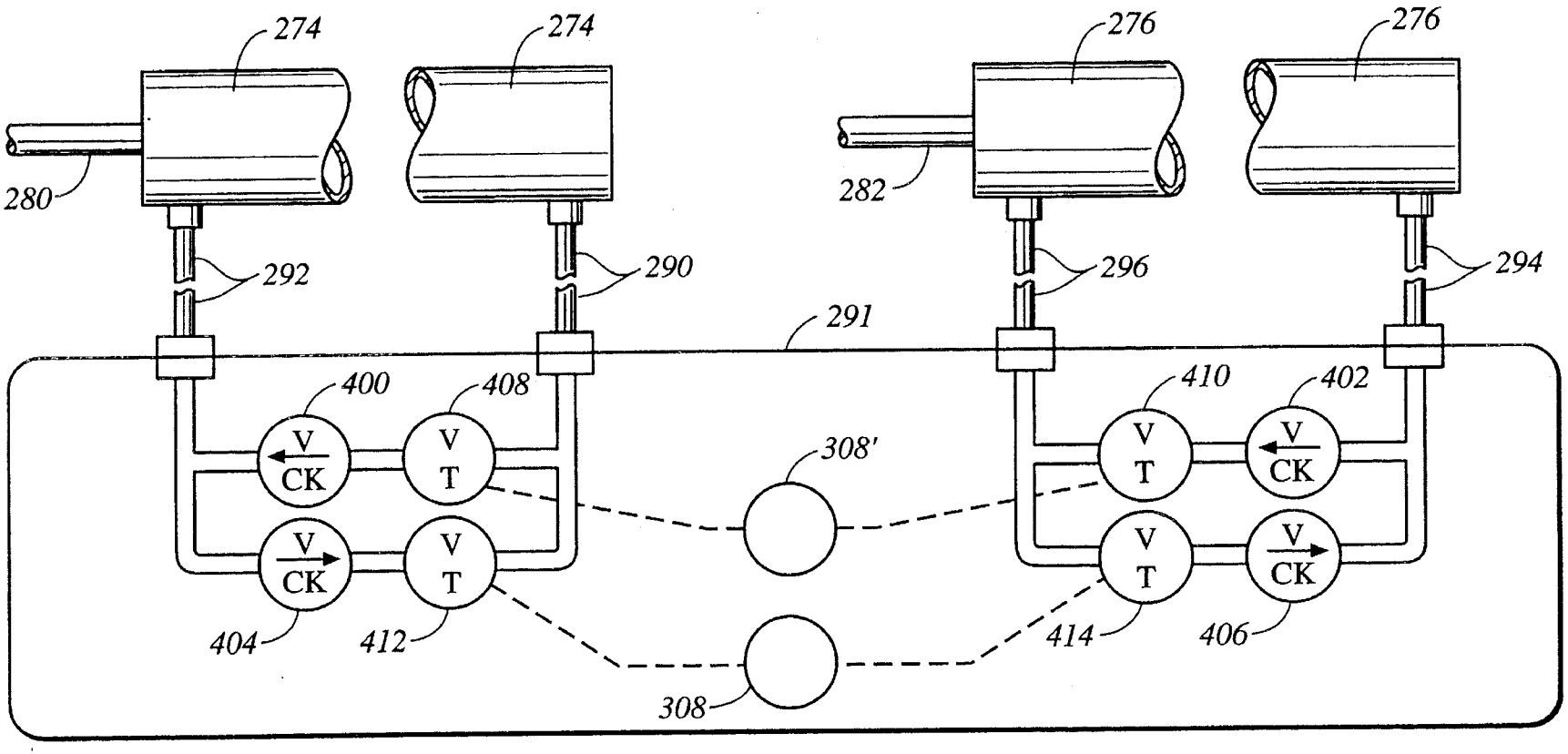
FIG. 8 is a schematic diagram of the hydraulic system of a variant of the second preferred embodiment of my invention shown in FIG. 6.

Referring now to FIG. 8, there is shown a schematic diagram of the hydraulic system of a variant of the second preferred embodiment of my invention.

It is to be understood that this variant of the second preferred embodiment of my invention differs from the second preferred embodiment as shown in FIG. 6, 6A and 7, and described hereinabove, only in the details of the hydraulic system shown in FIG. 8, and in the fact that control box 291 (FIG. 6) is provided with two control knobs 308, 308', control knob 308' being hidden behind control knob 308 in FIG. 6.

as shown in FIG. 8, control box 291 of said variant of the second preferred embodiment of my invention contains four check valves 400, 402, 404, 406 and four throttle valves 408, 410, 412, 414.

As schematically represented in FIG. 8, throttle valves 408 and 410 are mechanically coupled to a single manual control knob 308' whereby throttle valves 408 and 410 can simultaneously be manipulated between their fully open and their fully closed positions, so that when manual control knob 308' is in one extreme position both throttle valves 408, 410 are closed, when manual control knob 308' is in its other extreme position both throttle valves 408, 410 are fully open, and at any intermediate position of control knob 308' throttle valves 408, 410 are opened to the same degree.

Similarly, throttle valves 412 and 414 are mechanically coupled to a single manual control knob 308 whereby throttle valves 412 and 414 can simultaneously be manipulated between their fully open and their fully closed positions, so that when manual control knob 308 is in one extreme position both throttle valves 412, 414 are closed, when manual control knob 308 is in its other extreme position both throttle valves 412, 414 are fully open, and at any intermediate position of control knob 308 throttle valves 412, 414 are opened to the same degree.

As also shown in FIG. 8, check valve 400 and throttle valve 408 are connected in series fluid connection between hoses 290 and 292, check valve 404 and throttle valve 412 are connected in series fluid connection between hoses 290 and 292, throttle valve 410 and check valve 402 are connected in series fluid connection between the hoses 294 and 296, and throttle valve 414 and check valve 406 are connected in series fluid connection between hoses 294 and 296.

As further seen in FIG. 8, check valve 400 blocks fluid flow from hose 292 to hose 290 through throttle valve 408, check valve 404 blocks fluid flow from hose 290 to hose 292 through throttle valve 412, check valve 402 blocks fluid flow from hose 296 to hose 294 through throttle valve 410, and check valve 406 blocks fluid flow from hose 294 to 296 through throttle valve 414.

As will be evident to those having ordinary skill in the art, informed by the present disclosure, the hydraulic system of FIG. 7 is so constructed and arranged that the resistance to upward movement of pedals 264, 266 (FIG. 6) can be varied by manipulation of manual control knob 308', and the resistance to downward movement of pedals 264, 266 (FIG. 6) can be varied by manipulation of manual control knob 308.

Thus, it will be understood by those having ordinary skill in the art, informed by the present disclosure, that in the variant of the second preferred embodiment of my invention shown in FIGS. 6 and 8 and described hereinabove in connection therewith, manual control knobs 308, 308' can be so manipulated that the resistance to upward or contractile movement of pedals 264, 266 is greater than the resistance to downward or extensional movement of pedals 264, 266.

If found desirable or necessary, stop means may be provided to so limit the relative angular movements of manual control knobs 308, 308', respectively, that the resistance to the upward movement of pedals 264, 266 is always greater than the resistance to the downward movement of pedals 264, 266.

It will thus be seen that the objects set forth above, among those made apparent from the preceding description, are efficiently attained, and since certain changes may be made in the above constructions and the method carried out thereby without departing from the scope of my present invention, it is intended that all matter contained in the above description or shown in the accompanying drawings shall be interpreted as illustrative only, and not in a limiting sense.

It is to be understood, for example, that the bicycle chains 54, 54' of the first preferred embodiment may be replaced by cogged plastic belts of the well known type, and their associated sprockets changed to the corresponding well known type of sprocket adapted to be associated with such cogged plastic belts.

Alternatively, it may be found acceptable in some embodiments of my invention to replace bicycle chains 54, 54' with smooth belts, and to replace sprockets 52, 52', etc., with suitable pulleys, such as flanged pulleys cooperating with V-belts.

It is also within the scope of my present invention to incorporate in the physical conditioning apparatus of my invention means for automatically varying the resistance to pedal movement during each upward movement of each pedal. Thus, for example, it may be found desirable in certain variant versions of the first preferred embodiment of my invention to replace the circular sprockets 52, 52', 58, 58' with elliptical sprockets or with sprockets of other selected contour.

Alternatively, it may be found desirable in such variant versions of the first preferred embodiment of my invention to substitute for circular eccentric cams 80, 80' cams of other selected contour.

Yet further, in variant versions of the apparatus of the second preferred embodiment of my invention, it may be found desirable to employ a pneumatic resistance producing assembly rather than the hydraulic resistance producing assembly of the second preferred embodiment as shown in FIG. 6, whereby to take advantage of the well known cushioning effect of such pneumatic systems resulting from the compressibility of the air used as the working fluid.

It is further to be understood that it is within the scope of my invention, e.g., in certain variant versions of the second preferred embodiment of my invention shown in FIG. 6 to use vertically guided pedals which are constrained to operate along substantially vertical straight lines, rather than crank-mounted pedals.

In another variant of the second preferred embodiment of my invention a dual friction wheel concept is used, similar to a standard exercise bicycle in appearance but utilizing independent cranks and friction wheels with individual independent adjustments to resist rotation and individual adjustments to increase resistance on the upward stroke.

It is also within the scope of my invention to employ two separate weights, rather than a single weight, in the first preferred embodiment of my invention.

It is also within the scope of my invention to employ in certain embodiments of my invention electrical resistance producing means, e.g., a pair of small permanent magnet field generators having one of the pedal cranks attached to the input shaft of each of them and having a variable resistive load connected across the electrical output terminals of each of them, and further having an electrical strain gauge disposed beneath each electrical generator, each of which strain gauges operates a sensitive relay or silicon controlled rectifier which shunts the electrical load connected across its associated electrical generator whenever downward force is applied to that generator via the pedal crank attached to its mechanical output shaft, whereby to reduce the armature reaction and the resistance to shaft rotation and thus to reduce the resistance to pedal movement, whenever the associated pedal is pressed downward.

It is also to be understood that the following claims are intended to cover all of the generic and specific features of the present invention hereindescribed, and all statements of the scope of the present invention which, as a matter of language, might be said to fall therebetween.

What I claim is:

1. Physical conditioning apparatus, comprising:

a frame;

a crankshaft operationally connected to said frame;

first movable means mounted on said crankshaft for continuous rotational movement, each complete rotation of which includes an upstroke movement, during which said first movable means moves upward, and a downstroke movement, during which said first movable means moves downward;

second movable means mounted on said crankshaft for continuous rotational movement, each complete rotation of which includes an upstroke movement, during which said second movable means moves upward, and a downstroke movement, during which said second movable means moves downward;

first attaching means for attaching the left foot of a human user to said first movable means;

second attaching means for attaching the right foot of a human user to said second movable means;

first resistance producing means for producing net downstroke opposing force during each downstroke of said first movable means, and for producing net upstroke opposing force during each upstroke of said first movable means;

second resistance producing means for producing net downstroke opposing force during each downstroke of said second movable means, and for producing net upstroke opposing force during each upstroke of said second movable means; and body supporting means for supporting the body of said human user in such a position that said human user's feet can move said movable means upward and downward;

the net downstroke opposing force applied to said first movable means during one downstroke thereof being less than the net upstroke opposing force applied to said first movable means during the following upstroke thereof, and the net downstroke opposing force applied to said second movable means during one downstroke thereof being less than the net upstroke opposing force applied to said second movable means during the following upstroke thereof.

2. Physical conditioning apparatus as claimed in claim 1, further comprising selective coupling means for selectively either coupling together said first movable means and said second movable means for joint movement or uncoupling said first movable means and said second movable means for independent movement.

3. Physical conditioning apparatus, comprising:

a frame;

a crankshaft operationally connected to said frame;

first movable means mounted on said crankshaft for continuous rotational movement, each complete rotation of which includes an upstroke movement, during which said first movable means moves upward, and a downstroke movement, during which said first movable means moves downward;

second movable means mounted on said crankshaft for continuous rotational movement, each complete rotation of which includes an upstroke movement, during which said second movable means moves upward, and a downstroke movement, during which said second movable means moves downward;

first attaching means for attaching the left foot of a human user to said first movable means;

second attaching means for attaching the right foot of a human user to said second movable means;

first resistance producing means for producing net downstroke opposing force during each downstroke of said first movable means, and for producing net upstroke opposing force during each upstroke of said first movable means;

second resistance producing means for producing net downstroke opposing force during each downstroke of said second movable means, and for producing net upstroke opposing force during each upstroke of said second movable means; and body supporting means for supporting the body of said human user in such a position that said human user's feet can move said movable means upward and downward;

the net downstroke opposing force applied to said first movable means during one downstroke thereof being less than the net upstroke opposing force applied to said first movable means during the following upstroke thereof, and the net downstroke opposing force applied to said second movable means during one downstroke thereof being less than the net upstroke opposing force applied to said second movable means during the following upstroke thereof; and said first movable means and said second movable means being independently movable by the action of said human user's left and right feet, respectively.

4. Physical conditioning apparatus as claimed in claim 3, further comprising selective coupling means for selectively either coupling together said first movable means and said second movable means for joint movement or uncoupling said first movable means and said second movable means for independent movement.

* * * * *